United States Patent [19]

Lankard

[11] 4,339,289

[45] Jul. 13, 1982

[54] CONCRETE OVERLAY CONSTRUCTION

[75] Inventor: David R. Lankard, Columbus, Ohio

[73] Assignee: Battelle Development Corporation, Columbus, Ohio

[21] Appl. No.: 180,688

[22] Filed: Aug. 25, 1980

[51] Int. Cl.[3] ..... B32B 7/04; B32B 31/00

[52] U.S. Cl. ..... 156/91; 428/703; 404/28; 404/72; 427/136; 427/397.7

[58] Field of Search ..... 404/17, 28, 31, 70, 404/72, 75, 82; 427/136, 140, 126, 138, 386, 397.7, 403; 428/63, 703, 359, 360, 288, 280, 297, 303, 224; 264/256, 257, 258, 333; 156/71, 91

[56] References Cited

U.S. PATENT DOCUMENTS

| | | | |
|---|---|---|---|
| 3,038,393 | 6/1962 | Nagin et al. | 404/31 |
| 3,153,279 | 10/1964 | Chessin | 428/936 |
| 3,334,555 | 8/1967 | Nagin et al. | 404/31 |
| 3,429,094 | 2/1969 | Romualdi | 428/294 |
| 3,557,671 | 1/1971 | Vasiloff | 404/28 |
| 3,637,457 | 1/1972 | Gothard et al. | 428/288 |
| 3,986,885 | 10/1976 | Lankard | 106/99 |
| 4,065,924 | 1/1978 | Young | 428/63 |
| 4,068,968 | 1/1978 | Gagle et al. | 404/17 |
| 4,088,808 | 5/1978 | Cornwell et al. | 264/256 |
| 4,112,174 | 9/1978 | Hannes et al. | 428/220 |
| 4,133,928 | 1/1979 | Riley et al. | 428/280 |
| 4,135,029 | 1/1979 | Pfeffer | 428/288 |
| 4,148,660 | 4/1979 | Lankard | 106/38.3 |
| 4,203,788 | 5/1980 | Clear | 428/703 |
| 4,265,957 | 5/1981 | Severance | 404/82 |

OTHER PUBLICATIONS

Haynes, H. H., Investigation of Fiber Reinforcement Methods for Thin Shell Concrete, Naval Civil Eng. Lab. (Port Hueneme, Calif.), Technical Note N-979, Sep. 1968.

*Primary Examiner*—William J. Van Balen
*Attorney, Agent, or Firm*—Barry S. Bissell

[57] ABSTRACT

Crack and wear resistant concrete overlays for renovation or patching of deteriorated sections over a substratum can be made by incorporating 4–12 volume percent steel fibers in the concrete overlay and bonding at least a portion of the fibers directly to the substratum.

10 Claims, 2 Drawing Figures

CONCRETE OVERLAY CONSTRUCTION

BACKGROUND OF THE INVENTION

All concrete surfaces are subject to cracking and spalling. Roadways, airport runways, bridge decks, bridge piers, industrial flooring and other heavy-traffic, concrete pavements are all subject to stresses induced by thermal changes, freeze/thaw cycles and especially repeated flexing in response to loading. And although fiber-reinforced concretes are now available (see U.S. Pat. No. 3,429,094) which provide much higher flexural strengths than conventional concrete, the amount of fiber which can be effectively blended with the concrete is limited to about 2 volume percent. Due to this relatively low fiber content and to the fact that it is difficult to mix and consolidate steel fiber reinforced concretes containing even this limited amount of fiber (2 volume percent), flexural strengths attained on steel fiber reinforced concretes produced in the field are limited to the range of 800 to 1200 psi.

When used as an overlay for deteriorated concrete (or other) surfaces, it is desirable that the flexural strength be as high as possible to minimize the formation of cracks and to keep the cracks closely knit once they do form. In considering steel fiber reinforced concretes as overlay materials, both the flexural strength of the concrete and its bond to the substrate controls its performance and longevity. The present invention provides for both substantially improved flexural strength levels to resist cracking and subsequent crack propagation and a novel and superior bonding of the overlay concrete to the substrate material which is being rehabilitated.

SUMMARY OF THE INVENTION

It is an object to provide a method for overlaying a substratum with a concrete layer having a very high flexural strength.

It is an object to provide such high flexural strength by fiber reinforcement in a thin overlay.

It is also an object to provide such a fiber-reinforced concrete overlay with very high fiber loading to impart the high flexural strength.

It is further an object to provide a method for patching deteriorating sections of a building or construction surface using fiber-reinforced concrete with high fiber loading.

It is particularly an object to provide such methods for overlayment wherein the fiber reinforcement is directly bonded to the underlying substratum, thus also joining the concrete overlay through the reinforcement to the substratum for increased stability of the overlay.

In accordance with the objectives, the invention is a method for joining a thin, fiber-reinforced-concrete overlay to a supporting substratum by the steps of preparing the supporting substratum to accept a bonding agent, coating the prepared substratum with a bonding agent, placing a bed of loose, matted or bonded fibers having a preferred strength and a close spacing on the bonding coating and causing at least some of the lower fibers to adhere to the coating, and infiltrating the bed of fibers with a concrete mixture. The concrete mixture is thereby bonded directly to the fibers and to the substratum through the fibers and the bonding agent coating.

The infiltration of the fibers allows for at least about 4–12 volume percent fibers in the final overlay. With steel fibers, the concrete overlay may have a flexural strength of about 3000 to 6500 psi. The concrete mixture can be neat cement, mortar or grout, and may contain small aggregate.

The bonding agent may be any of the known agents which are useful in this wet environment and particularly the epoxy resins or cement paste. A thin surface mortar can be applied to the overlay or other wearing surfaces may be provided as described herein.

DETAILED DESCRIPTION OF THE INVENTION

The invention is useful in placing an overlay of a cement mixture over a supporting substratum, either as a new construction, or of total renovation or patching of a deteriorated construction or building surface. By the term concrete mixture or concrete herein we mean to include neat cement or cement paste (cement and water), mortar or grout (cement, water and sand), as well as conventional concrete containing cement, water, sand and aggregate. The cement will preferably be portland cement, although other inorganic cements, such as those comprising gypsum or calcium aluminate, may also be used in the concretes.

Figure 1:
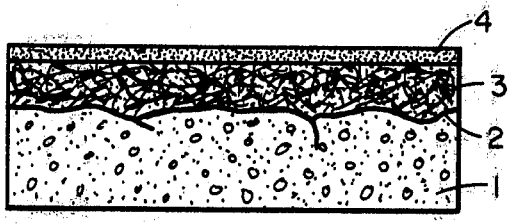
Figure 2:
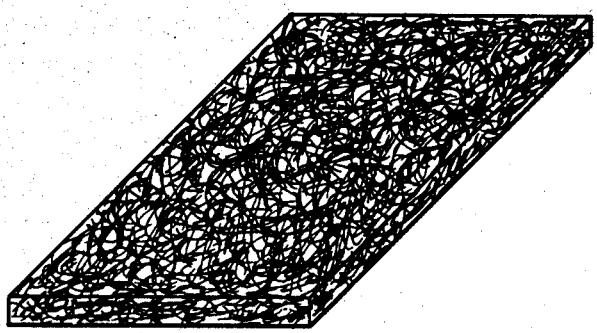

FIG. 1 shows the cross section of a repaired pavement using the invention. A deteriorated concrete substrate 1 is shown with severe erosion and cracking of the wearing surface. The surface thereof is prepared by debris removal, washing, etching, etc. and an adherent bonding layer 2 is applied over the prepared surface. The overlay 3 is then constructed by laying a bed of loose fibers or a preformed mat of fibers (such as shown in FIG. 2) to a depth of about ½–2 inches and the bottom fibers are made to physically penetrate the bonding layer 2 before it develops its strength. Concrete is then infiltrated into the fiber layer and a wearing surface 4 is incorporated into the overlayment.

In general, the invention is useful in new construction as a thin overlay to heavy wear areas, such as industrial floors, bridge decks, airport runways, dam spillways, or as a renovation or patching layer for deteriorated construction and building surfaces. The underlying layer or substratum will most likely be concrete and, if in deteriorated condition, will require some preparation. Generally, the preparation will include removal of loose debris and deteriorated portions, cleaning to remove grease, oil or other chemicals and possibly acid etching or scarifying to improve bonding by the intermediate bonding layer.

Once prepared, the substratum is coated with a layer of an adherent bonding agent. The bonding agent can be any of the known materials which can bond the substratum to the fibers in the water environment. This would include generally both inorganic and organic agents and in particular cement paste or resins of the epoxy or polyvinylacetate types. Epoxy resins or cement paste are preferred bonding agents.

While the bonding layer is still uncured, the bed of fibers is placed thereover with the bottom fibers making adherent contact with the layer. The fiber bed may be either loose or matted fibers and may be any convenient length but generally longer than the thickness of the overlay. The bed is conveniently about ½–2 inches in thickness.

Loose fibers are applied by sprinkling over the bonding layer and by subsequently rolling the fibers to orient them substantially in the plane of the substratum. This prevents fibers from sticking up above the overlay and also orients the fibers so that they contribute maximally to the flexural strength of the overlay. Since, during service, the force on the overlay is generally perpendicular to the plane of the overlay, fibers also oriented substantially perpendicularly to the overlay would not significantly contribute to arresting cracks and to improving the flexural strength of the overlay.

Preformed mats of fibers are also useful in practicing the invention. As shown in FIG. 2, such mats can be formed as discrete rectangular sections ½–2 inches thick or may be formed as a continuous roll up to several feet wide. The mat may be formed of one or a small number of continuous fiber(s) twisted and compressed on itself to cause linear segments of the fiber to be oriented in various directions and to intersect other segments. The twisted single fiber or the multiplicity of discontinuous fibers may be mechanically held together (by crimping, twisting, etc.) or may be chemically bonded together at contact points. We prefer to bond the fibers using a resinous material which is applied to the fibers (eg. by spraying or dipping), and then cured after the fibers are molded into the desired shape. However, in some processes of making fibers from a melt, the fibers may remain tacky for a period of time long enough to be formed and maneuvered directly into a mold wherein the fibers contact and stick to one another before solidifying.

As known in the art, fibers for either the loose bed or the preformed mat preferably have a modulus of elasticity of at least about 20 million psi and have an average spacing between fibers of less than about 0.3 inch. The fibers preferably are in such a packing arrangement so as to yield an infiltrated overlay which is between about 4 and 12 volume percent fibers. Flexural strength further increases with increasing amounts of fiber, but excessive fiber volumes makes infiltration by concrete difficult.

Glass fibers may be used, however, metal fibers such as suggested by this assignee's previous patents U.S. Pat. Nos. 3,429,094 and 3,986,885 are preferred herein. As found in the latter patent, improved results can be obtained with fibers having a cross-sectional area of about $2.5\times10^{-5}$ to $3\times10^{-3}$ square inch and length about ¼ to 3 inches with the average length about 40–300 times the square root of the average cross-sectional area. For circular cross-section fibers, the preferred diameters would be about 6–63 mils with average lengths of about 30–250 times the diameters.

However, in the present use longer fibers can be utilized since mixing of the fibers in the concrete mix is not required. In fact, continuous filaments can be used in prefabricating a fiber mat. This would obviate the need for bonding individual short fibers but would also result in some segments of the fiber being parallel to the direction of the load in the overlay. Discontinuous fibers of length slightly longer than the thickness of the overlay are especially preferred. For a ¾ inch overlay, fibers of ¾–1½ inches are preferred.

Commercially available concrete-reinforcing fibers may be used, such as are obtainable from National Standard Co., Bekaert Steel Wire Corporation and Ribbon Technology Corporation. Steel fibers may be made by any known means including slit sheet and melt extraction. Fiber made by melt extraction may lend itself to direct formation of fiber mats. Fibers extracted from the melt can be immediately directed to a mold (with or without an intermediate spray of a resin binder) wherein they contact other fibers and solidify.

The fiber bed is placed on the bonding layer such that at least a portion of the fibers adhere thereto. Before the bonding layer is cured, a concrete mixture is then infiltrated in the bed of fibers using vibration if necessary to work the concrete throughout the bed. As low a water/cement ratio as possible should be maintained. Superplasticizers are preferably used to increase fluidity. Other conventional additives such as fly ash or latex may also be used.

Aggregate can be used, however, the fibers act as a strainer to retain large aggregate on the surface. This technique can therefore be used deliberately to retain a surface layer above the fiber with large aggregate. Preferably, however, only small aggregate which can penetrate the commingled fibers is used in the concrete mixture and a thin, surface (finish) layer of mortar is later applied over the infiltrated fiber bed using conventional procedures (2-course bonded construction or dry shake procedures).

EXAMPLES OF THE PREFERRED EMBODIMENTS

Example 1

Conventional steel fiber-reinforced concrete contains up to about 2 volume percent fiber loading. Additional fiber loading results in poor workability and difficulty in consolidation. Flexural strengths of about 800–1200 psi are therefore about the upper limit for standard concrete batches containing up to 2 volume percent fiber.

Using the invention, several beam specimens were made incorporating 12 volume percent fiber loading. Fibers were steel, 0.016 inches in diameter and 0.75 inches long. The fibers were sprinkled in a 14"×4"×4" mold to a depth of 1½ inches and pressed to orient the fibers generally parallel to the top surface. The fiber layer was subsequently infiltrated with a Type III portland cement paste slurry or a Type III portland cement/sand slurry, using external vibration to assist in the infiltration. A superplasticizing admixture was used in all slurries at the rate of 21 cc per pound of cement (MELMET superplasticizer, American Admixtures Corporation, Chicago, Ill.).

After casting, the specimens were cured in the mold for 24 hours and then immersion cured (water) at 120° F. for 13 days. Flexural strengths under center point loading are given in Table 1.

TABLE 1

| Slurry Composition (weight ratio) | Average Flexural Strength, psi |
|---|---|
| Cement/flyash (70:30) | 5750 |
| Cement/Central silica #3 sand (1:1) | 5900 |
| Cement/Millwood #7 sand (2:1) | 5070 |
| Cement paste | 6540 |

Example 2

In a field trial, a seriously deteriorated section of concrete roadway was renovated using a 1 inch overlay (¾ inch infiltrated fiber bed and ¼ inch finish layer) according to the invention. Loose concrete and other debris were first removed by brooming followed by water hosing and high pressure air. The cracked and pitted surface was then acid etched using a 6:1 muratic acid solution.

A ¾ inch high wood form was erected over the surface followed by application of a cement paste bonding layer. The cement paste mixture was prepared to a thick paint consistency using Columbia Type III cement and water and applied approximately 1/16 inch thick using a brush.

While the bonding layer was still fluid, a ¾" bed of fibers (0.016 DIA×0.75 inch) was placed by sprinkling the fibers onto the bonding layer, screeding the fibers off of the wood forms and rolling the bed with a light roller merely to orient (not to consolidate) the fibers generally parallel to the pavement surface. The lower fibers made contact with the bonding layer.

Following placement of the fiber bed, a cement paste slurry was used to infiltrate it. The cement paste consisted of a batch of 70% (by weight) Columbia Type III portland cement, 30% flyash, about 30% water (based on the dry batch) and 21 cc per pound of dry batch of MELMET superplasticizer. The viscosity was adjusted to that of a very heavy oil and the temperature was kept at below about 50° F. to prolong working time.

The cement slurry was poured onto the fiber bed and vibrated. The cement slurry would not quite infiltrate the bed under its own weight but moved readily when vibrated. After infiltration the excess slurry was screeded off.

A ⅛ to ¼ inch mortar finish layer was applied using 1 part Type III portland cement to 2½ parts conventional concrete sand and again using 21 cc/lb of MELMET superplasticizer. Normal screeding (forms were built up ¼ inch for the finish layer) and float finishing completed the installation. A solvent-based acrylic curing compound, such as Protex Industries' Acryl Seal, was applied to the overlay surface to aid curing.

Fiber loading was calculated at about 6–12 volume percent and it was observed that the reinforcing fibers were being bonded directly to the underlay.

Example 3

A poor roadway surface similar to that renovated in Example 2 was prepared in the manner described therein and then renovated using the same technique but with the following variations. The bonding layer in this case was an epoxy resin sold under the name Sikadur Hi-mod by Sika Chemical Corporation. It was applied at the rate of 30 square feet per gallon.

Fibers were again sprinkled on the bonding layer and bonded thereto. The fibers were slit sheet fibers 0.10×0.022 inch in cross section and 1 inch long. Fiber loading was calculated at 8 volume percent. The remaining slurry infiltration and mortar surface coating were placed as described in Example 2.

Example 4

The renovation described in Example 3 was reproduced but in this case the fibers were prefabricated into mats prior to placement on the bonding layer. The mats were fabricated by coating the steel fibers with an acrylic emulsion (Standard Dry Wall Products' Acryl 60), placing the coated fibers in a 3 foot by 3 foot by ¾ inch wood form and curing the coating by placing in the sun. The resulting mat was firm but flexible and could be bent through about 60 degree without cracking or losing substantial number of fibers.

The mats were simply placed on the bonding layer and infiltrated with slurry as described in Example 3. Such use of mats greatly decreases the labor of handling and placing of fibers on site.

We claim:

1. A method for overlaying a highly reinforced concrete layer on a supporting substratum comprising A. coating the supporting substratum with an adherent bonding agent, B. placing a bed of fibers having an average fiber spacing of less than about 0.3 inch on the bonding agent coating and causing at least a portion of such fibers to adhere thereto, and C. infiltrating the bed of fibers with a concrete mixture and causing the concrete mixture to adhere to the bonding agent coating and the fibers.

2. The method for overlaying concrete as in claim 1 which additionally comprises forming a concrete surface layer over the bed of fibers wherein the concrete mixture comprises aggregate having an average diameter greater than the average fiber spacing.

3. The method of claim 1 for overlaying concrete which comprises the additional step of providing a finish layer of mortar over the infiltrated bed of fibers.

4. The method of claim 1 for overlaying concrete wherein the concrete mixture comprises portland cement and water with one or more additives selected from the group consisting of latex, sand, aggregate and a superplasticizing agent.

5. The method of claim 1 for overlaying concrete wherein the supporting substratum is also concrete.

6. The method of claim 1 for overlaying concrete wherein the bonding agent is either a resinous material or cement paste.

7. The method of claim 6 for overlaying concrete wherein the bonding agent is an epoxy resin.

8. The method of claim 1 for overlaying concrete wherein the fiber bed is placed by sprinkling loose discontinuous fibers on the bonding agent coating.

9. The method of claim 1 for overlaying concrete wherein the bed of fibers comprises a preformed mat.

10. The method of claim 8 or 9 wherein the fibers comprises between about 4–12 volume percent of the overlay.

* * * * *